US009724574B2

(12) United States Patent
Hayashi

(10) Patent No.: US 9,724,574 B2
(45) Date of Patent: Aug. 8, 2017

(54) GOLF CLUB HEAD

(71) Applicant: DUNLOP SPORTS CO. LTD., Kobe-shi, Hyogo (JP)

(72) Inventor: Kazuhiro Hayashi, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/649,110

(22) PCT Filed: Oct. 18, 2013

(86) PCT No.: PCT/JP2013/078291
§ 371 (c)(1),
(2) Date: Jun. 2, 2015

(87) PCT Pub. No.: WO2014/087747
PCT Pub. Date: Jun. 12, 2014

(65) Prior Publication Data

US 2015/0314174 A1 Nov. 5, 2015

(30) Foreign Application Priority Data

Dec. 3, 2012 (JP) ..... 2012-264322

(51) Int. Cl.
*A63B 53/04* (2015.01)

(52) U.S. Cl.
CPC ..... *A63B 53/0466* (2013.01); *A63B 53/04* (2013.01); *A63B 2053/0433* (2013.01)

(58) Field of Classification Search
CPC ..... A63B 2053/0433
USPC ..... 473/344, 345
See application file for complete search history.

(56) References Cited

U.S. PATENT DOCUMENTS

2011/0021284 A1* 1/2011 Stites ..... A63B 53/0466 473/329

FOREIGN PATENT DOCUMENTS

| | | | | | |
|---|---|---|---|---|---|
| JP | 11-299939 | A | | 11/1999 | |
| JP | 11299939 | A | * | 11/1999 | ..... A63B 53/04 |
| JP | 1207912 | S | * | 6/2004 | ..... A63B 53/04 |
| JP | 1207912 | S | | 6/2004 | |
| JP | 2009-240363 | A | | 10/2009 | |
| JP | 2011-072662 | A | | 4/2011 | |
| JP | 2011072662 | | * | 4/2011 | ..... A63B 53/04 |

OTHER PUBLICATIONS

International Search Report issued in PCT/JP2013/078291 dated Dec. 3, 2013.

* cited by examiner

*Primary Examiner* — Aarti B Berdichevsky
*Assistant Examiner* — Rayshun Peng
(74) *Attorney, Agent, or Firm* — Birch, Stewart, Kolasch & Birch, LLP

(57) ABSTRACT

A sole surface f8 of a head 2 includes a first sole region R1. An outer edge of the region R1 includes a first edge line Eg1, a second edge line Eg2, a third edge line Eg3, and a fourth edge line Eg4. The line Eg1 is inclined so as to come closer to a face surface toward a toe side. The line Eg2 is inclined so as to come closer to the face surface toward a heel side. The line Eg3 is inclined so as to come closer to the face surface toward the heel side. The line Eg4 is inclined so as to come closer to the face surface toward the toe side. The lines Eg1 to Eg4 are joined to form a single line.

6 Claims, 11 Drawing Sheets

GOLF CLUB HEAD

TECHNICAL FIELD

The present invention relates to a golf club head.

BACKGROUND ART

There has been known a golf club head having a devised sole shape.

Japanese Patent Application Laid-Open No. 2011-72662 discloses a sole part including a sole front part, a sole middle part, and a flat part. The sole front part includes a backward extending part on each of the toe side and the heel side of the sole middle part.

Japanese Patent Application Laid-Open No. 2009-240363 discloses a golf club head including a sole part and a crown part which connect a face part and a back part to each other. The sole part includes a face side portion and a back side portion. The mass of the face side portion is greater than the mass of the back side portion.

CITATION LIST

Patent Literature

Patent Literature 1: JP-A-2011-72662
Patent Literature 2: JP-A-2009-240363

SUMMARY OF INVENTION

Technical Problem

A golf course has various lie situations. A head having high adaptability to a change in lie is preferable. A head having small ground resistance is preferable. In other words, a head having an excellent sliding property of a sole is preferable.

It is an object of the present invention to provide a golf club head having high adaptability to a change in lie, and having an excellent sliding property of a sole.

Solution to Problem

A golf club head according to the present invention includes a face surface, a sole surface, and a leading edge. The sole surface includes a first sole region. An outer edge of the first sole region includes a first edge line, a second edge line, a third edge line, and a fourth edge line. The first edge line is inclined so as to come closer to the face surface toward a toe side. The second edge line is inclined so as to come closer to the face surface toward a heel side. The third edge line is inclined so as to come closer to the face surface toward the heel side. The fourth edge line is inclined so as to come closer to the face surface toward the toe side. Aback side end of the first edge line and a back side end of the second edge line are joined via a connecting point A. A face side end of the first edge line and a back side end of the third edge line are joined via a connecting point B. A face side end of the second edge line and a backside end of the fourth edge line are joined via a connecting point C. The connecting point B is located on the toe side with respect to a face center. The connecting point C is located on the heel side with respect to the face center. An outer surface of the first sole region has a projecting curve on a section including the connecting point B and the connecting point C. The outer surface of the first sole region has a projecting curve on a section including the connecting point A and the face center.

Preferably, the sole surface further includes: a second sole region located on the toe side with respect to a face side end point D of the third edge line; a third sole region located on the heel side with respect to a face side end point E of the fourth edge line; a fifth edge line extending on the toe side from the end point D, and a sixth edge line extending on the heel side from the end point E. Preferably, the second sole region and the third sole region smoothly continue toward a back side from the leading edge. Preferably, the second sole region is located between the fifth edge line and the leading edge. Preferably, the third sole region is located between the sixth edge line and the leading edge.

Preferably, the sole surface further includes a front sole region. Preferably, the front sole region forms a continuous surface smoothly joining the leading edge and the first sole region.

Preferably, the sole surface further includes a front sole region. Preferably, the front sole region forms a continuous surface smoothly joining the leading edge and the first sole region. Preferably, the front sole region forms a continuous surface smoothly joining the second sole region and the third sole region.

Preferably, the head is formed by welding a face member and the remainder including one or more members to each other. Preferably, a welding position of the face member and the other member on the face surface is defined as Pk. At this time, a distance between the welding position Pk and the end point E in a toe-heel direction is preferably equal to or less than 10 mm.

Advantageous Effects of Invention

There can be provided a golf club head having high adaptability to a change in lie, and having an excellent sliding property of a sole.

DESCRIPTION OF EMBODIMENTS

The present invention will be described below in detail based on preferred embodiments with appropriate reference to the drawings.

[Definitions of Terms]

In the present application, a base perpendicular plane, a face-back direction, and a toe-heel direction are defined. A state where a center axial line Z1 of a shaft hole is included in a plane P1 perpendicular to a level surface H and a head 2 is placed at a predetermined lie angle and real loft angle on the level surface H is defined as a base state. The plane VP1 is defined as the base perpendicular plane. The predetermined lie angle and real loft angle are described in, for example, a product catalog.

[Toe-Heel Direction]

In the present application, the toe-heel direction is a direction of an intersection line between the base perpendicular plane and the level surface H.

[Face-Back Direction]

In the present application, the face-back direction is a direction perpendicular to the toe-heel direction and parallel to the level surface H.

[Section in Toe-Heel Direction]

A plane parallel to the toe-heel direction and perpendicular to the level surface H is defined as Pth. In the present application, a section in the toe-heel direction is a section of the head in the base state along the plane Pth.

[Section in Face-Back Direction]

A plane parallel to the face-back direction and perpendicular to the level surface H is defined as Pfb. In the present application, a section in the face-back direction is a section of the head in a base state along the plane Pfb.

[Face Center]

In the present application, a face center Fc is defined. On a face surface, a maximum width Wx in the toe-heel direction is determined. Furthermore, a middle position Px of the maximum width Wx in the toe-heel direction is determined. At the position Px, a middle point Py of the face surface in an up-down direction is determined. The point Py is defined as the face center Fc.

[Sole Height Hs]

Figure 8:
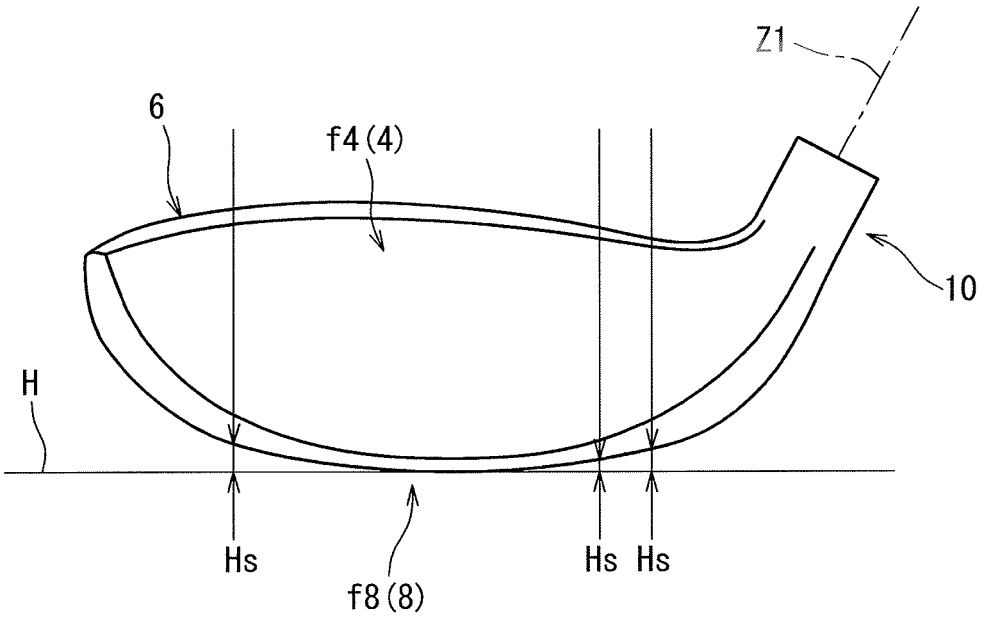
FIG. 8 is a front view of the head of FIG. 1.

In the head in the base state, a height from the level surface H is a sole height Hs. The sole height Hs is measured along a direction perpendicular to the level surface H. The sole height Hs may be determined at each of points on a sole surface. A point having a larger sole height Hs is less likely to be grounded. The sole height Hs is shown in FIG. 8 to be described later.

[Planar View of Bottom Face of Head]

Figure 2:
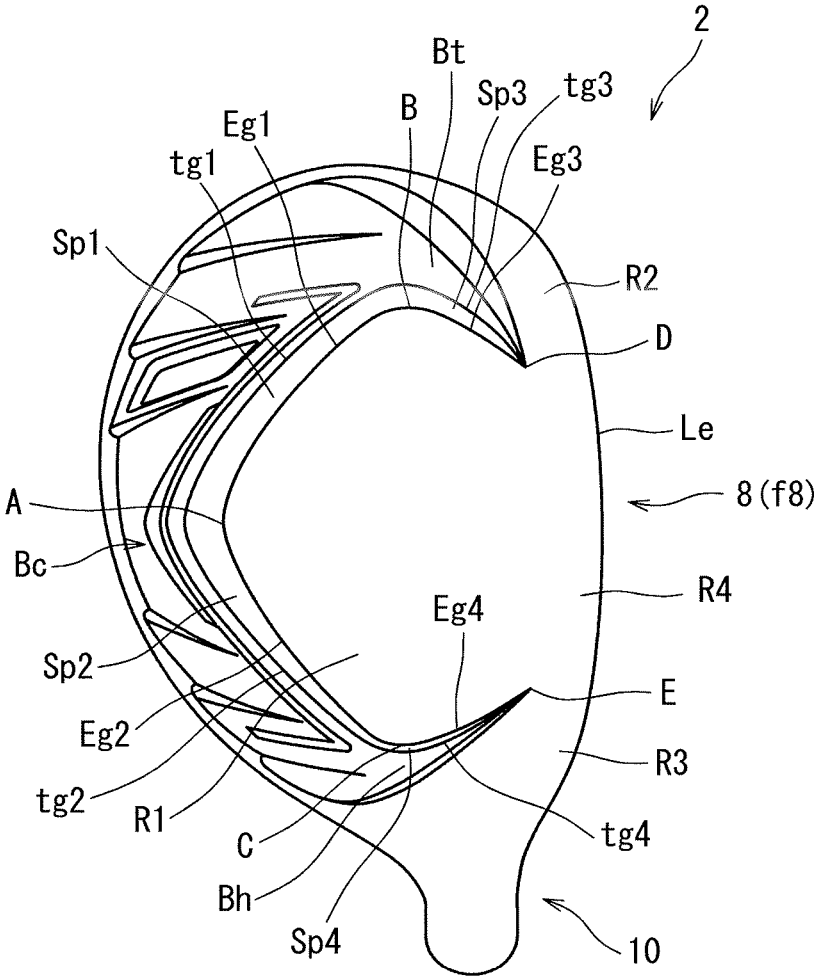
FIG. 2 is a bottom view of the head of FIG. 1.

In the present application, a planar view of a bottom face of the head is defined. In the head in the base state, a projection image obtained by projecting the bottom face of the head on the level surface H is the planar view. A projection direction in the projection is a direction perpendicular to the level surface H. In the present application, the planar view of the bottom face of the head is merely referred to as the planar view. In the head 2 to be described later, the planar view of the bottom face of the head is shown in FIG. 2 to be described later.

Figure 1:
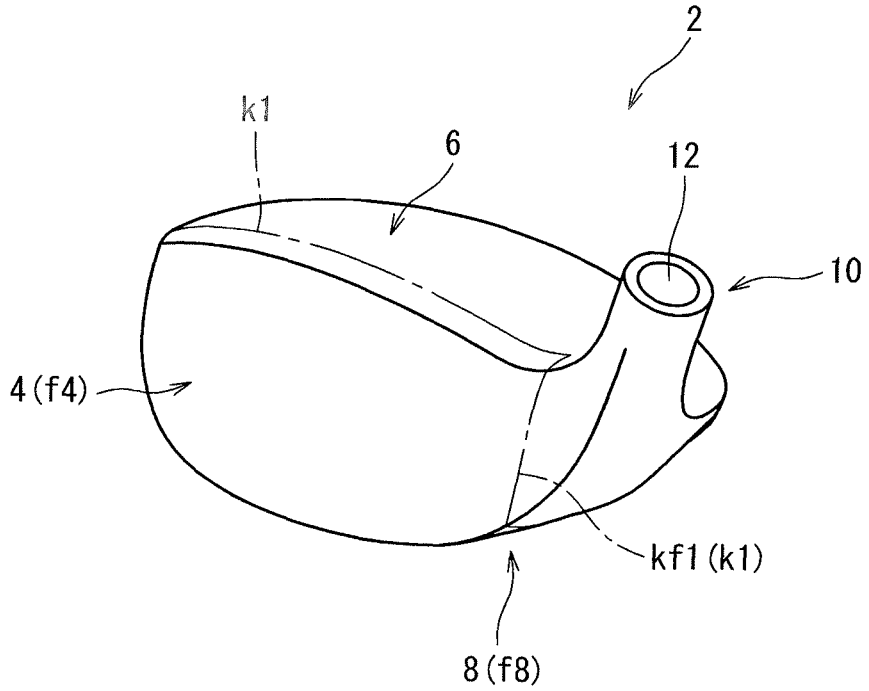
FIG. 1 is a perspective view of a head according to a first embodiment of the present invention.
Figure 3:
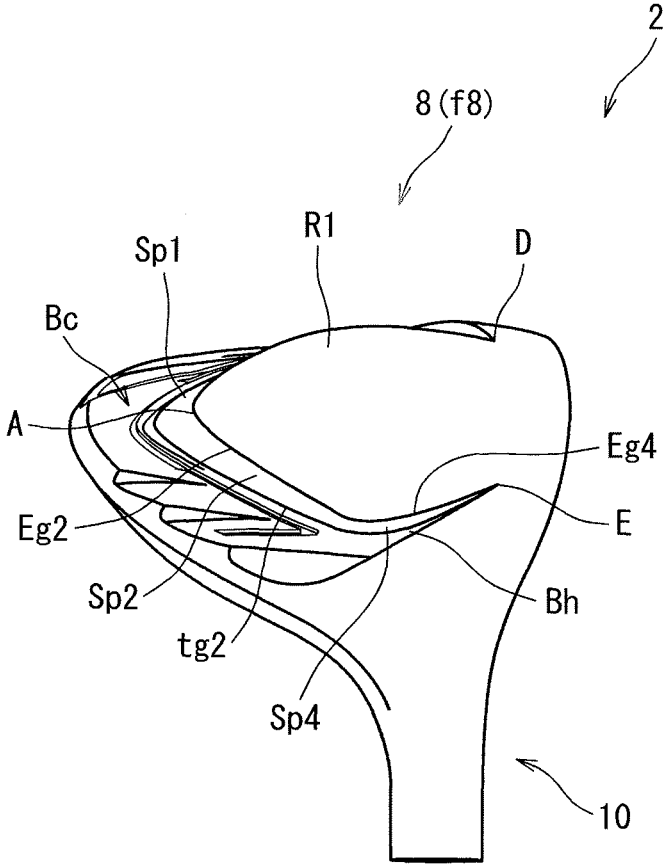
FIG. 3 is a perspective view of the head of FIG. 1 as viewed from a heel side.
Figure 4:
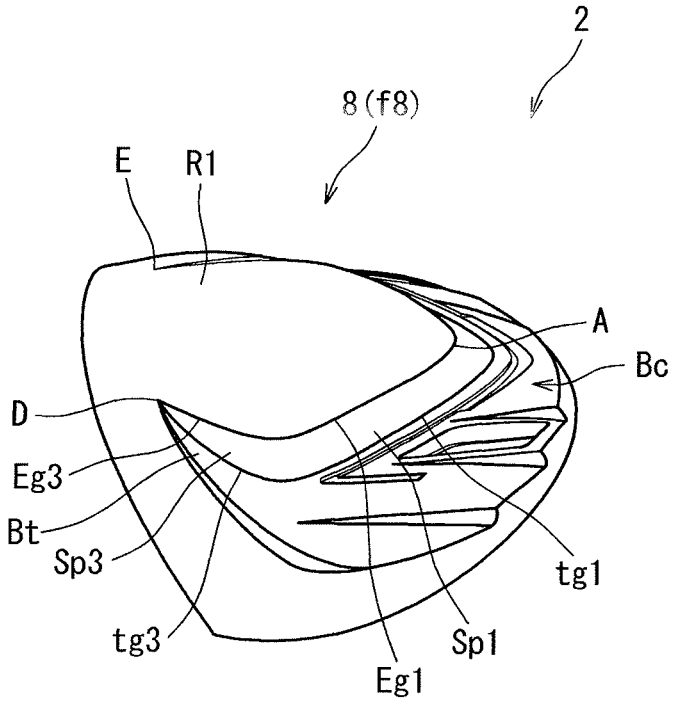
FIG. 4 is a perspective view of the head of FIG. 1 as viewed from a toe side.
Figure 5:
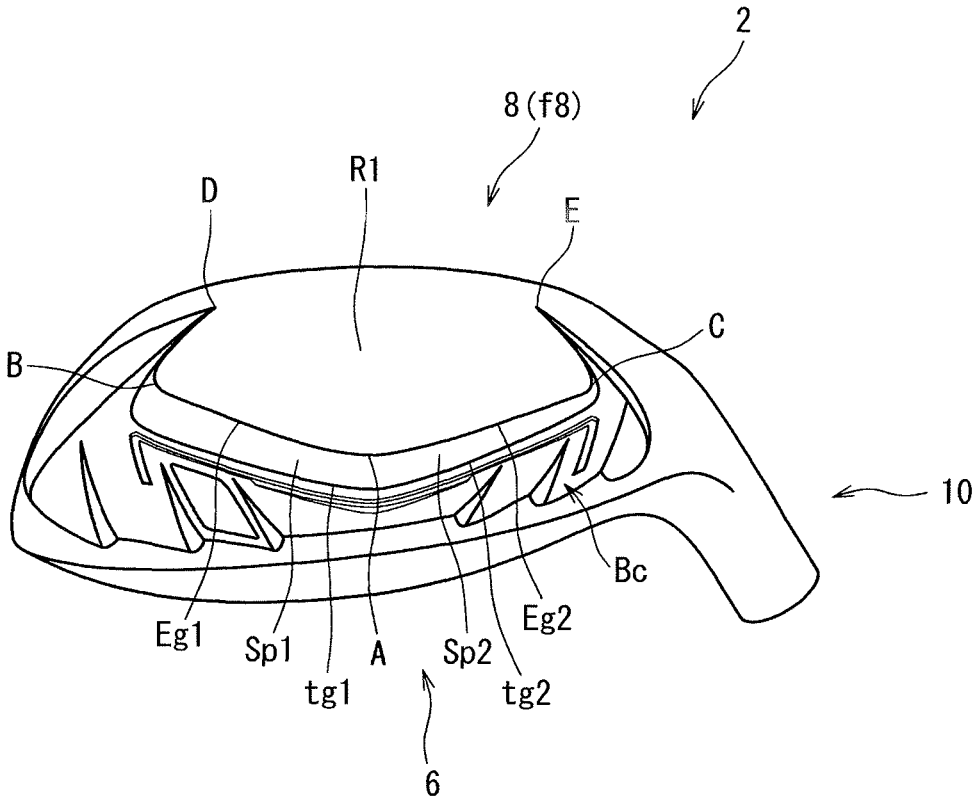
FIG. 5 shows the head of FIG. 1 as viewed from a back side.

FIG. 1 is a perspective view of a golf club head 2 according to a first embodiment of the present invention. FIG. 2 is a bottom view of the head 2. FIG. 3 is a perspective view of the head 2 as viewed from a heel side. FIG. 4 is a perspective view of the head 2 as viewed from a toe side. FIG. 5 shows the head 2 as viewed from a back side.

The head 2 includes a face 4, a crown 6, a sole 8, and a hosel 10. The face 4 includes a face surface f4. The face surface f4 is a hitting surface. The sole 8 includes a sole surface f8. The sole surface f8 is an outer surface of the sole. The head 2 is hollow. The head 2 is a so-called wood type golf club head.

The head 2 is manufactured by joining a plurality of members. The junction is welding. A boundary line k1 of the joined part is shown in FIG. 1. The boundary line k1 will be described in detail later.

The hosel 10 has a shaft hole 12 for attaching a shaft (see FIG. 1). The shaft (not shown) is inserted into the shaft hole 12. The shaft hole 12 has a center axial line Z1 (not shown). The center axial line Z1 coincides with a shaft axial line of a golf club including the head 2.

The sole surface f8 includes a first sole region R1. In the base state, the first sole region R1 is brought into contact with the level surface H. In the base state, only the first sole region R1 is brought into contact with the level surface H.

The first sole region R1 is located at an approximate middle of the sole surface f8. The first sole region R1 includes a center of figure of an outline of the head in the planar view. The first sole region R1 includes whole circle having a radius of 15 mm about the center of figure which is the center of the circle.

Although not shown, partial recesses are provided in the first sole region R1. These recesses show a character and a mark or the like. Typically, the character shows a trade name, a brand name, a loft angle, and a number or the like. Except for these partial recesses, the whole first sole region R1 smoothly continues. In the first sole region R1, the smooth continuous portion is a curved surface. The curved surface has projecting roundness in the toe-heel direction (see FIG. 5).

The curved surface has projecting roundness in the face-back direction (see FIGS. 3 and 4). The curved surface is a three-dimensional projecting curved surface. In respect of reducing ground resistance, the width of the partial recess is preferably equal to or less than 8 mm. The partial recess is located inside edge lines Eg1, Eg2, Eg3, and Eg4 to be described later.

As shown in FIG. 2, an outer edge of the first sole region R1 includes a first edge line Eg1, a second edge line Eg2, a third edge line Eg3, and a fourth edge line Eg4.

The first edge line Eg1 is inclined so that it comes closer to the face surface f4 toward the toe side. In the planar view, the first edge line Eg1 is a curved line. The curved line is curved so that it projects toward the back side.

The second edge line Eg2 is inclined so that it comes closer to the face surface f4 toward the heel side. In the planar view, the second edge line Eg2 is a curved line. The curved line is curved so that it projects toward the back side.

The third edge line Eg3 is inclined so that it comes closer to the face surface f4 toward the heel side. In the planar view, the third edge line Eg3 is a curved line. The curved line is curved so that it projects toward the toe side.

The fourth edge line Eg4 is inclined so that it comes closer to the face surface f4 toward the toe side. In the planar view, the fourth edge line Eg4 is a curved line. The curved line is curved so that it projects toward the heel side.

The edge lines Eg1, Eg2, Eg3, and Eg4 are ridge lines. These edge lines Eg1, Eg2, Eg3, and Eg4 are joined. One edge line is formed by the joining. Both ends points of the one edge line are a point D and a point E. Although these edge lines Eg1, Eg2, Eg3, and Eg4 form an edge of the first sole region R1, the edge preferably has roundness. The curvature radius of the roundness is small enough to visually recognize the ridge line as the edge line. In the roundness, points in which the curvature radius is the minimum constitute the edge lines Eg1, Eg2, Eg3, and Eg4. The roundness can reduce the ground resistance. The curvature radius is determined in the section in the face-back direction. When a portion (curvature-radius minimum portion) in which the curvature radius is the minimum is not a point but has a width in the roundness of the edge, the section of the curvature-radius minimum portion in the face-back direction is a curved line. In this case, middle points of the curved line constitute the edge lines Eg1, Eg2, Eg3, and Eg4.

The middle point of the first edge line Eg1 is located on the toe side with respect to the face center Fc. The middle point of the second edge line Eg2 is located on the heel side with respect to the face center Fc. The middle point of the third edge line Eg3 is located on the toe side with respect to the face center Fc. The whole third edge line Eg3 is located on the toe side with respect to the face center Fc. The middle point of the fourth edge line Eg4 is located on the heel side with respect to the face center Fc. The whole fourth edge line Eg4 is located on the heel side with respect to the face center Fc.

A back side end of the first edge line Eg1 and a back side end of the second edge line Eg2 are joined via a connecting point A.

A face side end of the first edge line Eg1 and a back side end of the third edge line Eg3 are joined via a connecting point B.

A face side end of the second edge line Eg2 and a back side end of the fourth edge line Eg4 are joined via a connecting point C.

A face side end point of the third edge line is represented by reference character D in FIG. 2. Both ends of the third edge line Eg3 are a point B and a point D.

The point D is located on the back side with respect to a leading edge Le. The point D may be located on the leading edge Le.

A face side end point of the fourth edge line is represented by reference character E in FIG. 2. Both ends of the fourth edge line Eg4 are a point C and a point E.

The point E is located on the back side with respect to the leading edge Le. The point E may be located on the leading edge Le.

The back side end of the first edge line Eg1 and the back side end of the second edge line Eg2 may be joined by other edge line Eg12 (not shown). In this case, a middle point of the line Eg12 is the connecting point A. Examples of the line Eg12 include an edge line parallel to the toe-heel direction.

The face side end of the first edge line Eg1 and the back side end of the third edge line Eg3 may be connected by other edge line Eg13 (not shown). In this case, a middle point of the line Eg13 is the connecting point B. Examples of the line Eg13 include an edge line parallel to the face-back direction.

The face side end of the second edge line Eg2 and the back side end of the fourth edge line Eg4 may be joined by other edge line Eg24 (not shown). In this case, a middle point of the line Eg24 is the connecting point C. Examples of the line Eg24 include an edge line parallel to the face-back direction.

The connecting point A is located in a middle range in the toe-heel direction. The middle range in the toe-heel direction means a range between a position separated by 10 mm from the face center Fc to the toe side and a position separated by 10 mm from the face center Fc to the heel side.

The connecting point A is located on the back side with respect to the center of figure of the outline of the head in the planar view. The connecting point A is located on the back side with respect to a grounding point (or grounding portion) with the level surface H in the base state.

The connecting point B is located on the toe side with respect to the face center Fc. The connecting point C is located on the heel side with respect to the face center Fc.

An outer surface of the first sole region R1 has a projecting curve on a section including the connecting point B and the connecting point C. The projecting curve improves adaptability to a side hill lie (ball above feet) and a side hill lie (ball below feet). The head 2 is easily addressed on both the side hill lie (ball above feet) and the side hill lie (ball below feet). In the head 2 in the base state, the section including the point B and the point C is perpendicular to the level surface H.

The outer surface of the first sole region R1 has a projecting curve on a section including the, connecting point A and the face center Fc. The projecting curve improves adaptability to an uphill lie and a downhill lie. The head 2 is easily addressed on both the uphill lie and the downhill lie. In the head 2 in the base state, the section including the connecting point A and the face center Fc is perpendicular to the level surface H.

A sole-back part Bc is provided on a back side of the first sole region R1. In the embodiment, unevenness such as a level difference is applied to the sole-back part Bc.

An inclined surface Sp1 is provided on a back side of the edge line Eg1 (see FIG. 4 or the like). A level difference between the first sole region R1 and the sole-back part Bc is enlarged due to the inclined surface Sp1. An inclined surface Sp2 is provided on a back side of the edge line Eg2 (see FIG. 3 or the like). The level difference between the first sole region R1 and the sole-back part Bc is enlarged due to the inclined surface Sp2.

In the embodiment, the sole-back part Bc is a back side portion of the inclined surface Sp1 and the inclined surface Sp2 in the sole surface f8.

In order to describe an effect of the level difference between the first sole region R1 and the sole-back part Bc, an impact will be described. The impact means a state where a ball and the face surface f4 are brought into contact with each other. Although the time of the impact is short, a predetermined time is required for the impact. The impact starts by the start of the contact of the ball with the face surface f4. During the impact, the ball is deformed so that it is crushed, and the deformation is then recovered. Then, the ball is separated from the face surface f4, and the impact is completed.

At the initial stage of the impact, a portion of the sole surface f8 closer to the face is likely to be grounded. Meanwhile, at the final stage of the impact, a portion of the sole surface f8 closer to the back is likely to be grounded. As a swing progresses, the posture of the head 2 is changed during the impact so that the back side is lowered. At the final stage of the impact, the back side of the head 2 is likely to be strongly grounded due to the change of the posture. The ground resistance at the final stage of the impact is suppressed by the level difference between the first sole region R1 and the sole-back part Bc. Therefore, a sliding property of the sole is improved.

In the section in the face-back direction, the maximum value of the sole height Hs in the first sole region R1 is defined as R1$x$, and the minimum value of the sole height Hs in the sole-back part Bc is defined as Bcn. In respect of the sliding property of the sole, in all the toe-heel directions between the point B and the point C, a difference (Bcn−R1$x$) is preferably greater than 0, more preferably equal to or greater than 1 mm, still more preferably equal to or greater than 2 mm, and yet still more preferably equal to or greater than 3 mm. In respect of lowering the center of gravity of the head, in all the toe-heel directions between the point B and the point C, the difference (Bcn−R1$x$) is preferably equal to or less than 10 mm, more preferably equal to or less than 9 mm, and still more preferably equal to or less than 8 mm.

In the section in the face-back direction, a level difference formed by the inclined surface Sp1 is defined as Ds1 (not shown). In respect of improving the sliding property of the sole, the level difference Ds1 is preferably equal to or greater than 1 mm, more preferably equal to or greater than 2 mm, and still more preferably equal to or greater than 3 mm.

In respect of lowering the center of gravity of the head, the level difference Ds1 is preferably equal to or less than 10 mm, more preferably equal to or less than 9 mm, and still more preferably equal to or less than 8 mm.

If the sole height Hs at a starting point of the inclined surface Sp1 is defined as Hf1, and the sole height Hs at an end point of the inclined surface Sp1 is defined as Hb1, the level difference Ds1 is a difference (Hb1−Hf1). The starting point of the inclined surface Sp1 is a point on the line Eg1. The end point of the inclined surface Sp1 is a point on a valley line tg1. The level difference Ds1 can be measured at all positions in the toe-heel direction.

In light of the balance between the sliding property of the sole and restriction of a sole size, the width of the inclined surface Sp1 in the planar view is preferably equal to or greater than 2 mm, and more preferably equal to or greater than 5 mm, and preferably equal to or less than 10 mm, and more preferably equal to or less than 7 mm. The width of the inclined surface Sp1 is measured along the face-back direction.

In the section in the face-back direction, a level difference formed by the inclined surface Sp2 is defined as Ds2 (not shown). In respect of improving the sliding property of the sole, the level difference Ds2 is preferably equal to or greater than 2 mm, more preferably equal to or greater than 3 mm, and still more preferably equal to or greater than 4 mm.

In respect of lowering the center of gravity of the head, the level difference Ds2 is preferably equal to or less than 8 mm, more preferably equal to or less than 7 mm, and still more preferably equal to or less than 6 mm.

If the sole height Hs at a starting point of the inclined surface Sp2 is defined as Hf2 and the sole height Hs at an end point of the inclined surface Sp2 is defined as Hb2, the level difference Ds2 is a difference (Hb2−Hf2). The starting point of the inclined surface Sp2 is a point on the line Eg2. The end point of the inclined surface Sp2 is a point on a valley line tg2. The level difference Ds2 can be measured at all the positions in the toe-heel direction.

The minimum value of the level difference Ds1 is greater than the maximum value of the level difference Ds2. Generally, an average golfer is known to have a strong tendency to hit a ball in not an inside-out path but an outside-in path. In the outside-in path, a grounding surface is likely to pass through the level difference Ds1 (see FIG. 9 to be described later). The grounding of a portion closer to the back of the sole surface f8 at the final stage of the impact is suppressed in the outside-in path by comparatively increasing the level difference Ds1. Therefore, the sliding property of the sole is improved. Meanwhile, the center of gravity of the head is prevented from being excessively high by comparatively decreasing the level difference Ds2. Since the level difference Ds2 is present, an effect of improving the sliding property of the sole is secured also in the inside-out path.

In light of the balance between the sliding property of the sole and restriction of a sole size, the width of the inclined surface Sp2 in the planar view is preferably than 2 mm or greater and 8 mm or less. The width of the inclined surface Sp2 is measured along the face-back direction.

A sole-toe part Bt is provided on the toe side of the third edge line Eg3 (see FIGS. 2 and 4). The sole-toe part Bt and the sole-back part Bc form portions having a comparatively large sole height Hs. Since the sole height Hs is large, the sole-toe part Bt is less likely to be grounded. The sole-toe part Bt is inclined and extended so that it comes closer to the face surface f4 toward the heel side. The width of the sole-toe part Bt in the face-back direction is decreased toward the face, and is zero at a position closest to the face. The width of the sole-toe part Bt in the toe-heel direction is decreased toward the face, and is zero at a position closest to the face. As shown in FIG. 2, in the planar view, the sole-toe part Bt is sharpened.

An inclined surface Sp3 is provided on the toe side of the edge line Eg3. The inclined surface Sp3 is located between the first sole region R1 and the sole-toe part Bt. The sole-toe part Bt is less likely to be grounded due to the inclined surface Sp3. On the section in the toe-heel direction, a level difference formed by the inclined surface Sp3 is defined as Ds3 (not shown). In respect of improving the sliding property of the sole, the level difference Ds3 is preferably equal to or greater than 1 mm, more preferably equal to or greater than 2 mm, and still more preferably equal to or greater than 3 mm. In respect of lowering the center of gravity of the head, the level difference Ds3 is preferably equal to or less than 10 mm, more preferably equal to or less than 9 mm, and still more preferably equal to or less than 8 mm.

If the sole height Hs at a starting point of the inclined surface Sp3 is defined as Hf3, and the sole height Hs at an end point of the inclined surface Sp3 is defined as Hb3, the level difference Ds3 is a difference (Hb3−Hf3). The starting point of the inclined surface Sp3 is a point on the line Eg3. The end point of the inclined surface Sp3 is a point on a valley line tg3. The level difference Ds3 can be measured at all positions in the face-back direction.

A sole-heel part Bh is provided on the heel side of the fourth edge line Eg4 (see FIGS. 2 and 3). The sole-heel part Bh and the sole-back part Bc form a portion having a comparatively large sole height Hs. Since the sole height Hs is large, the sole-heel part Bh is less likely to be grounded. The sole-heel part Bh is inclined and extended so that it comes closer to the face surface f4 toward the toe side. The width of the sole-heel part Bh in the face-back direction is decreased toward the face, and is zero at a position closest to the face. The width of the sole-heel part Bh in the toe-heel direction is decreased toward the face, and is zero at a position closest to the face. As shown in FIG. 2, in the planar view, the sole-heel part Bh is sharpened.

An inclined surface Sp4 is provided on the heel side of the edge line Eg4. The inclined surface Sp4 is located between the first sole region R1 and the sole-heel part Bh. The sole-heel part Bh is less likely to be grounded due to the inclined surface Sp4. On the section in the toe-heel direction, a level difference formed by the inclined surface Sp4 is defined as Ds4 (not shown). In respect of improving the sliding property of the sole, the level difference Ds4 is preferably equal to or greater than 1 mm, more preferably equal to or greater than 2 mm, and still more preferably equal to or greater than 3 mm. In respect of lowering the center of gravity of the head, the level difference Ds4 is preferably equal to or less than 10 mm, more preferably equal to or less than 9 mm, and still more preferably equal to or less than 8 mm.

If the sole height Hs at a starting point of the inclined surface Sp4 is defined as Hf4, and the sole height Hs at an end point of the inclined surface Sp4 is defined as Hb4, the level difference Ds4 is a difference (Hb4−Hf4). The starting point of the inclined surface Sp4 is a point on the line Eg4. The end point of the inclined surface Sp4 is a point on a valley line tg4. The level difference Ds4 can be measured at all the positions in the face-back direction.

Figure 6:
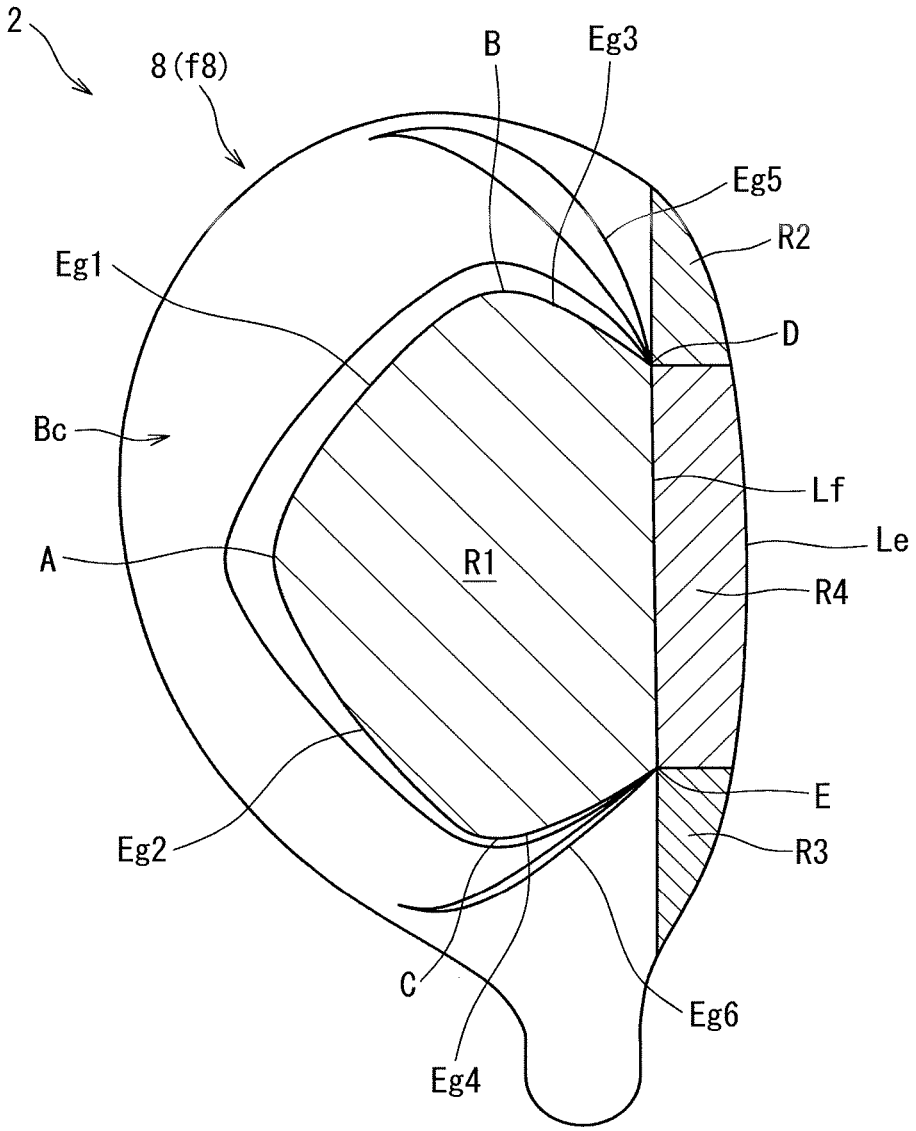
FIG. 6 is an enlarged view of FIG. 2, and each region on a sole surface is shown by hatching in FIG. 6.

In FIG. 6, regions on the sole surface f8 are sectioned by different hatchings. A straight line Lf shown in FIG. 6 is a line segment connecting the point D and the point E to each other. The straight line Lf is defined in the planar view. The first sole region R1 is surrounded by an edge line leading to the point E from the point D via the points B, A, and C, and the line segment Lf.

In light of the visibility of the drawing, the unevenness provided on the sole-back part Bc is not shown in FIG. 6.

The sole surface f8 includes a second sole region R2 and a third sole region R3 in addition to the first sole region R1. Furthermore, the sole surface f8 includes a front sole region R4.

The second sole region R2 is located on the toe side with respect to the end point D. The second sole region R2 is located on the face side with respect to the end point D.

The third sole region R3 is located on the heel side with respect to the end point E. The third sole region R3 is located on the face side with respect to the end point E.

The sole surface f8 includes a fifth edge line Eg5 extending to the toe side from the endpoint D. The sole surface f8 includes a sixth edge line Eg6 extending to the heel side from the end point E.

The second sole region R2 is located between the leading edge Le and the fifth edge line Eg5. The third sole region R3 is located between the leading edge Le and the sixth edge line Eg6.

The second sole region R2 smoothly continues toward the back side from the leading edge Le. A continuous surface smoothly joining the leading edge Le and the fifth edge line Eg5 is formed, and the second sole region R2 is a part of the continuous surface.

The third sole region R3 smoothly continues toward the back side from the leading edge Le. A continuous surface smoothly joining the leading edge Le and the sixth edge line Eg6 is formed, and the third sole region R3 is a part of the continuous surface.

The front sole region R4 is smoothly joined to the first sole region R1. The front sole region R4 forms a continuous surface smoothly joining the leading edge Le and the first sole region R1.

The front sole region R4 forms a continuous surface smoothly joining the second sole region R2 and the third sole regions R3.

The front sole region R4 may not be provided. In this case, the first sole region R1 preferably forms a continuous surface smoothly extending to the back side from the leading edge Le.

FIG. 8 is a front view of the head 2. FIG. 8 shows the above-mentioned base state. As described above, the sole height Hs is defined in the present application. The sole height Hs may be determined at all points on the sole surface f8.

On the sole surface f8, the sole height Hs of the first sole region R1 is comparatively small. Therefore, the first sole region R1 is likely to be grounded. Since the first sole region R1 is likely to be comparatively grounded, effects of the edge lines Eg1 to Eg4 is likely to be exhibited. In this respect, the sole height Hs of the first sole region R1 is preferably suppressed within a predetermined range. Specifically, the sole height Hs is as follows. On the section in the face-back direction, the sole height Hs of the leading edge Le is defined as HLe, and the maximum value of the sole height Hs in the first sole region R1 is defined as Hm1. Preferably, at all the positions in the toe-heel direction, the absolute value of a difference (HLe−Hm1) is preferably equal to or less than 6 mm, and more preferably equal to or less than 5 mm. The absolute value is equal to or greater than 0 mm.

On the sole surface f8, the second sole region R2 forms a continuous surface smoothly extending to the back side from the leading edge Le. Therefore, at the initial stage of the impact, the leading edge Le is less likely to be thrust into the ground, which can reduce the ground resistance. The level difference between the second sole region R2 and the leading edge Le is small. The height of the face surface f4 on the toe side can be increased due to the presence of the second sole region R2. Therefore, the deflection of the face surface f4 is increased, which can increase a coefficient of restitution. A high restitution area is enlarged to the toe side, and a decrease in a flight distance caused by the deviation of a hitting point is suppressed. In these respects, the sole height Hs of the second sole region R2 is preferably suppressed within a predetermined range. Specifically, the sole height Hs is as follows. On the section in the face-back direction, the sole height Hs of the leading edge Le is defined as HLe, and the maximum value of the sole height Hs in the second sole region R2 is defined as Hm2. Preferably, at all the positions in the toe-heel direction, the absolute value of a difference (HLe−Hm2) is preferably equal to or less than 6 mm, and more preferably equal to or less than 5 mm. The absolute value is equal to or greater than 0 mm.

On the sole surface f8, the third sole region R3 forms a continuous surface smoothly extending to the back side from the leading edge Le. Therefore, at the initial stage of the grounding, the leading edge Le is less likely to be thrust into the ground, which can reduce the ground resistance. The level difference between the third sole region R3 and the leading edge Le is small. The height of the face surface f4 on the heel side can be increased due to the presence of the third sole region R3. Therefore, the deflection of the face surface f4 is increased, which can increase a coefficient of restitution. A high restitution area is enlarged to the heel side, and a decrease in a flight distance caused by the deviation of a hitting point is suppressed. In these respects, the sole height Hs of the third sole region R3 is preferably suppressed within a predetermined range. Specifically, the sole height Hs is as follows. On the section in the face-back direction, the sole height Hs of the leading edge Le is defined as HLe, and the maximum value of the sole height Hs in the third sole region R3 is defined as Hm3. Preferably, at all the positions in the toe-heel direction, the absolute value of a difference (HLe−Hm3) is preferably equal to or less than 6 mm, and more preferably equal to or less than 5 mm. The absolute value is equal to or greater than 0 mm.

On the sole surface f8, the front sole region R4 forms a continuous surface smoothly extending to the back side from the leading edge Le. Therefore, at the initial stage of the grounding, the leading edge Le is less likely to be thrust into the ground, which can reduce the ground resistance. The level difference between the front sole region R4 and the leading edge Le is small. The height of the face surface f4 in a central part in the toe-heel direction can be increased due to the presence of the front sole region R4. Therefore, the deflection of the face surface f4 is increased, which can increase a coefficient of restitution. In these respects, the sole height Hs of the front sole region R4 is preferably suppressed within a predetermined range. Specifically, the sole height Hs is as follows. On the section in the face-back direction, the sole height Hs of the leading edge Le is defined as HLe, and the maximum value of the sole height Hs in the front sole region R4 is defined as Hm4. Preferably, at all the positions in the toe-heel direction, the absolute value of a difference (HLe−Hm4) is preferably equal to or less than 6 mm, and more preferably equal to or less than 5 mm. The absolute value is equal to or greater than 0 mm.

The second sole region R2, the front sole region R4, and the third sole region R3 extend along the leading edge Le. The three regions R2, R3, and R4 form a smooth continuous surface. At the initial stage of the grounding, the leading edge Le is less likely to be thrust into the ground due to the continuous surface, which can reduce the ground resistance.

The front sole region R4 and the first sole region R1 form a smooth continuous surface. The sole surface f8 is likely to be slid on the ground (lawn) due to the continuous surface, which can reduce the ground resistance. The first sole region R1 is smoothly grounded due to the presence of the front sole region R4. Therefore, an effect of the first sole region R1 is further increased.

[Effect of First Sole Region R1]

The first sole region R1 has an approximately pentagonal shape formed by the lines Eg1 to Eg4 and the straight line Lf. A distance between the leading edge Le and the point A in the face-back direction is long due to the orientations of the lines Eg1 to Eg4. On the section including the point A and the face center Fc, the outer surface of the first sole region R1 has a projecting curve. Therefore, the first sole region R1 has high adaptability to a change in the lie in the face-back direction.

The distance between the point B and the point C is increased due to the approximately pentagonal shape. On the section including the point B and the point C, the outer surface of the first sole region R1 has a projecting curve. Therefore, the projecting curve provides high adaptability to a change in the lie in the toe-heel direction.

A straight swing path, an inside-out swing path, and an outside-in swing path are known as a swing path. The swing path varies among golfers. The swing path may be changed also by the lie (inclination of the ground, or the like). Examples of the lie include a downhill lie, an uphill lie, a sidehill lie (ball below feet), and a sidehill lie (ball above feet).

Figure 9:
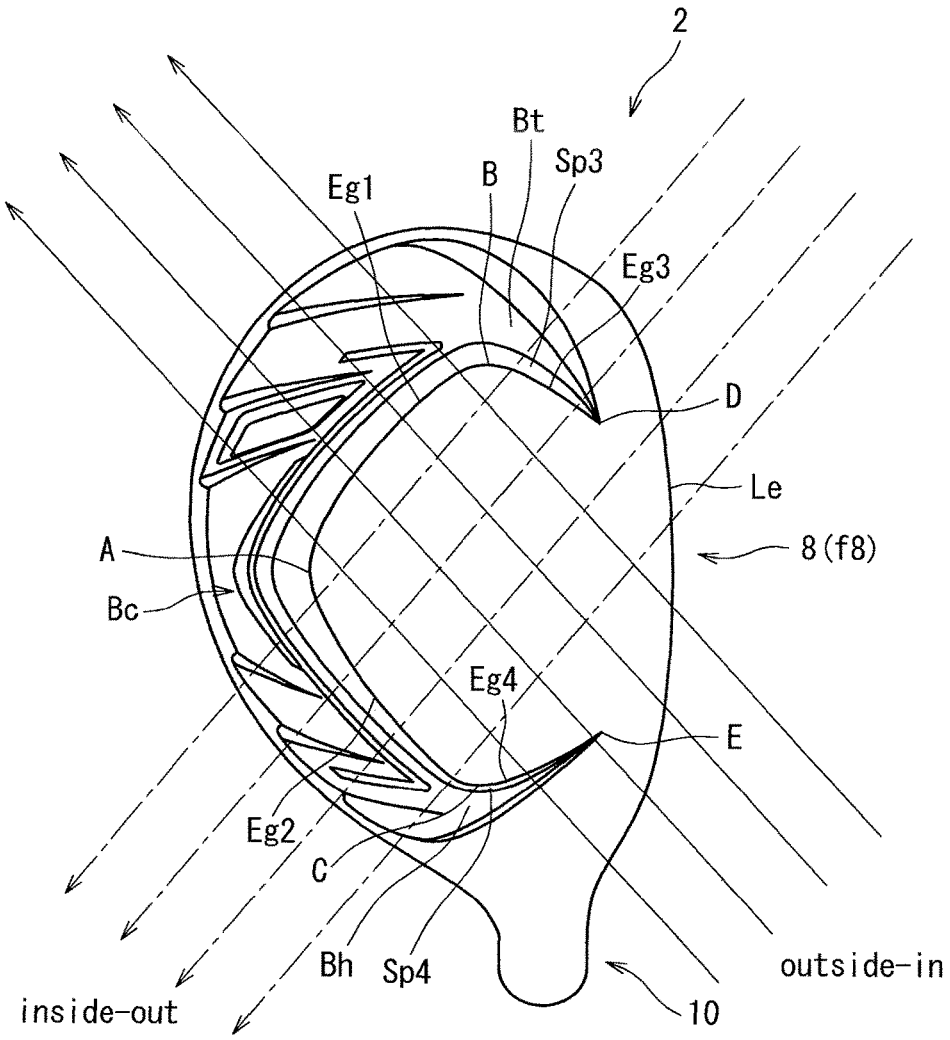
FIG. 9 shows the relation between a swing path and a grounding portion.

FIG. 9 is a bottom view showing the relation between a swing path and a grounding area. When the swing path is inside-out, the grounding is likely to occur between the region located on the face side on the toe side and the region located on the back side on the heel side (see an arrow represented by a dashed dotted line in FIG. 9). Meanwhile, when the swing path is outside-in, the grounding is likely to occur between the region located on the face side on the heel side and the region located on the back side on the toe side (see an arrow represented by a solid line in FIG. 9).

[Inclination Effect a of First Edge Line Eg1]

When the swing path is outside-in, the first edge line Eg1 is inclined as described above, and thereby the first sole region R1 is less likely to be grounded at the final stage of the impact. Therefore, the sliding property of the sole is improved.

[Inclination Effect b of First Edge Line Eg1]

When the swing path is inside-out, the edge line Eg1 is inclined as described above, and thereby the width of the first sole region R1 in a path orthogonal direction is decreased (see FIG. 9). Therefore, the ground resistance can be reduced. The path orthogonal direction means a direction orthogonal to the swing path.

[Inclination Effect c of Second Edge Line Eg2]

When the swing path is inside-out, the edge line Eg2 is inclined as described above, and thereby the second sole region R2 is less likely to be grounded at the final stage of the impact. Therefore, the sliding property of the sole is improved.

[Inclination Effect d of Second Edge Line Eg2]

When the swing path is outside-in, the edge line Eg2 is inclined as described above, and thereby the width of the first sole region R1 in the path orthogonal direction is decreased (see FIG. 9). Therefore, the ground resistance can be reduced.

[Inclination Effect e of Third Edge Line Eg3]

When the swing path is outside-in, the edge line Eg3 is inclined as described above, and thereby the width of the first sole region R1 in the path orthogonal direction is decreased (see FIG. 9). Therefore, the ground resistance can be reduced. The inclination effect e is further increased by synergy with the inclination effect d of the edge line Eg2.

In respect of preventing a fat shot, the outside-in swing path is preferable on the sidehill lie (ball below feet).

Therefore, in this case, the inclination effect d and the inclination effect e are more effectively exhibited.

[Inclination Effect f of Fourth Edge Line Eg4]

When the swing path is inside-out, the edge line Eg4 is inclined as described above, and thereby the width of the first sole region R1 in the path orthogonal direction is decreased (see FIG. 9). Therefore, the ground resistance can be reduced. The inclination effect f is further increased by synergy with the inclination effect b of the edge line Eg1.

In respect of preventing a fat shot, the inside-out swing path is preferable on the sidehill lie (ball above feet). Therefore, in this case, the inclination effect b and the inclination effect f are more effectively exhibited.

As described above, the shape of the first sole region R1 provides high adaptability to a change in the lie in addressing and high adaptability to a change in the swing path. This facilitates the swing. The head 2 can be adapted for various situations in a golf course, and is effective for an improvement in a score.

[Inclination Angles of Edge Lines Eg1 to Eg4]

Figure 7:
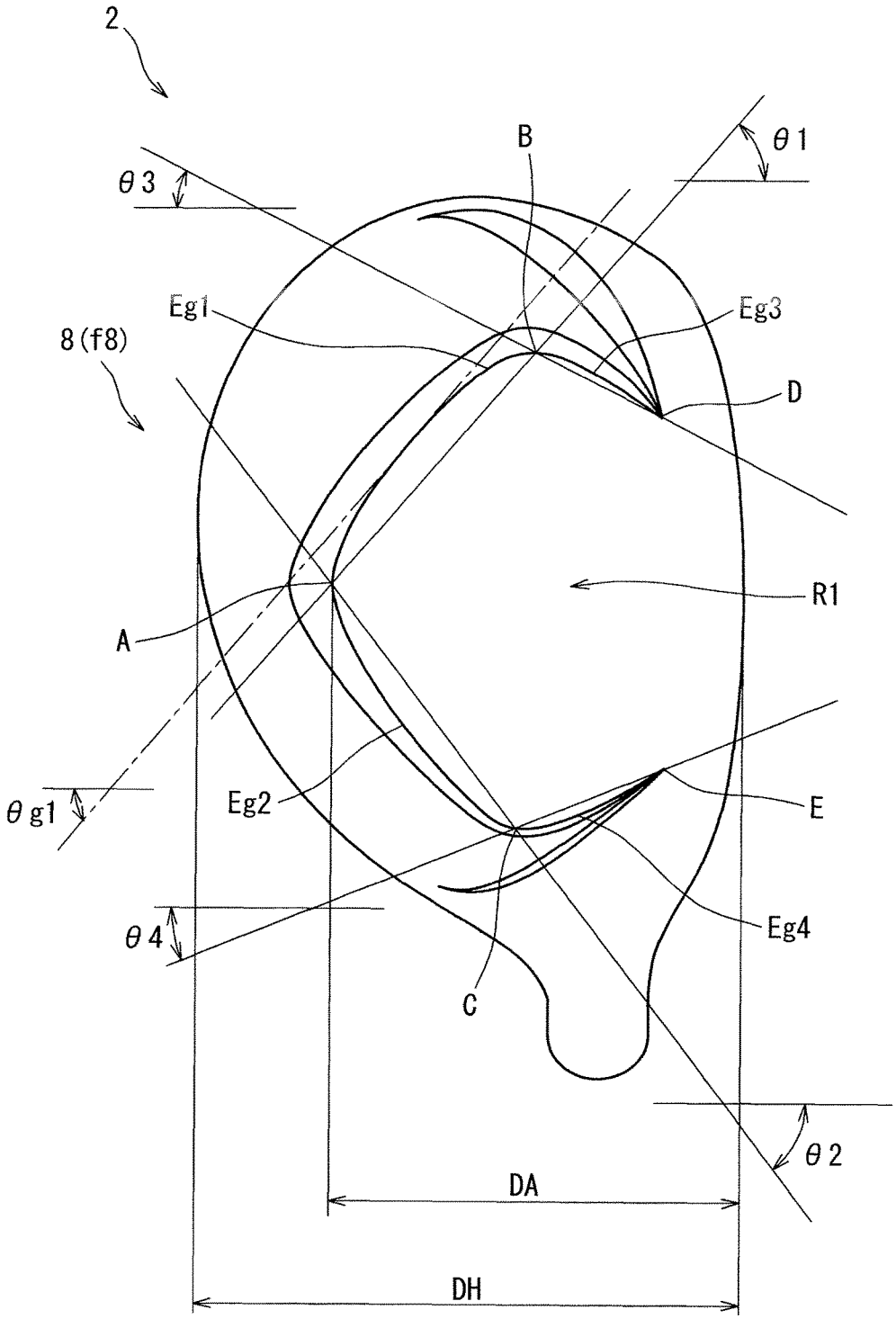
FIG. 7 is an enlarged view of FIG. 2, and angles θ1 to θ4 are shown in FIG. 7.

An inclination angle of a straight line connecting the point A and the point B to each other is represented by a double-headed arrow el in FIG. 7. The angle θ1 is an angle with respect to the face-back direction. The angle θ1 is measured in the planar view. In light of the swing path which may ordinarily occur, the lower limit of the angle θ1 is preferably equal to or greater than 20 degrees, more preferably equal to or greater than 30 degrees, and still more preferably equal to or greater than 40 degrees. The upper limit of the angle θ1 is preferably equal to or less than 80 degrees, more preferably equal to or less than 70 degrees, and still more preferably equal to or less than 60 degrees.

An inclination angle of a straight line connecting the point A and the point C to each other is represented by a double-headed arrow θ2 in FIG. 7. The angle θ2 is an angle with respect to the face-back direction. The angle θ2 is measured in the planar view. In light of the swing path which may ordinarily occur, the lower limit of the angle θ2 is preferably equal to or greater than 20 degrees, more preferably equal to or greater than 30 degrees, and still more preferably equal to or greater than 40 degrees. The upper limit of the angle θ2 is preferably equal to or less than 80 degrees, more preferably equal to or less than 70 degrees, and still more preferably equal to or less than 60 degrees.

An inclination angle of a straight line connecting the point B and the point D to each other is represented by a double-headed arrow θ3 in FIG. 7. The angle θ3 is an angle with respect to the face-back direction. The angle θ3 is measured in the planar view. In light of the swing path which may ordinarily occur, the lower limit of the angle θ3 is preferably equal to or greater than 5 degrees, more preferably equal to or greater than 10 degrees, and still more preferably equal to or greater than 20 degrees. The upper limit of the angle θ3 is preferably equal to or less than 60 degrees, more preferably equal to or less than 50 degrees, and still more preferably equal to or less than 40 degrees.

An inclination angle of a straight line connecting the point C and the point E to each other is represented by a double-headed arrow θ4 in FIG. 7. The angle θ4 is an angle with respect to the face-back direction. The angle θ4 is measured in the planar view. In light of the swing path which may ordinarily occur, the lower limit of the angle θ4 is preferably equal to or greater than 2 degrees, more preferably equal to or greater than 5 degrees, and more preferably equal to or greater than 10 degrees. The upper limit of the angle θ4 is preferably equal to or less than 50 degrees, more preferably equal to or less than 40 degrees, and still more preferably equal to or less than 30 degrees.

In the present application, an inclination angle θg1 of the first edge line Eg1 can be determined. The angle θg1 is an angle with respect to the face-back direction. The angle θg1 is an angle in the planar view. The angle θg1 is determined at the middle point of the line Eg1. When the line Eg1 is a curved line, the angle θg1 is an angle of a tangent at the middle point of the line Eg1 (see FIG. 7). The middle point is determined based on a length Lg1 of the first edge line Eg1 (described later). In light of the swing path which may ordinarily occur, the lower limit of the angle θg1 is preferably equal to or greater than 20 degrees, more preferably equal to or greater than 30 degrees, and still more preferably equal to or greater than 40 degrees. The upper limit of the angle θg1 is preferably equal to or less than 80 degrees, more preferably equal to or less than 70 degrees, and still more preferably equal to or less than 60 degrees.

Although not shown, in the present application, an inclination angle θg2 of the second edge line Eg2 can be determined. The angle θg2 is an angle with respect to the face-back direction. The angle θg2 is an angle in the planar view. The angle θg2 is determined at the middle point of the line Eg2. When the line Eg2 is a curved line, the angle θg2 is an angle of a tangent at the middle point of the line Eg2. The middle point is determined based on a length Lg2 of the second edge line Eg2 (described later). In light of the swing path which may ordinarily occur, the lower limit of the angle θg2 is preferably equal to or greater than 20 degrees, more preferably equal to or greater than 30 degrees, and still more preferably equal to or greater than 40 degrees. The upper limit of the angle θg2 is preferably equal to or less than 80 degrees, more preferably equal to or less than 70 degrees, and still more preferably equal to or less than 60 degrees.

Although not shown, in the present application, an inclination angle θg3 of the third edge line Eg3 can be determined. The angle θg3 is an angle with respect to the face-back direction. The angle θg3 is an angle in the planar view. The angle θg3 is determined at the middle point of the line Eg3. When the line Eg3 is a curved line, the angle θg3 is an angle of a tangent at the middle point of the line Eg3. The middle point is determined based on a length Lg3 of the third edge line Eg3 (described later). In light of the swing path which may ordinarily occur, the lower limit of the angle θg3 is preferably equal to or greater than 5 degrees, more preferably equal to or greater than 10 degrees, and still more preferably equal to or greater than 20 degrees. The upper limit of the angle θg3 is preferably equal to or less than 60 degrees, more preferably equal to or less than 50 degrees, and still more preferably equal to or less than 40 degrees.

Although not shown, in the present application, an inclination angle θg4 of the fourth edge line Eg4 can be determined. The angle θg4 is an angle with respect to the face-back direction. The angle θg4 is an angle in the planar view. The angle θg4 is determined at the middle point of the line Eg4. When the line Eg4 is a curved line, the angle θg4 is an angle of a tangent at the middle point of the line Eg4. The middle point is determined based on a length Lg4 of the fourth edge line Eg4 (described later). In light of the swing path which may ordinarily occur, the lower limit of the angle θg4 is preferably equal to or greater than 2 degrees, more preferably equal to or greater than 5 degrees, and still more preferably equal to or greater than 10 degrees. The upper limit of the angle θg4 is preferably equal to or less than 50 degrees, more preferably equal to or less than 40 degrees, and still more preferably equal to or less than 30 degrees.

A head maximum width in the face-back direction is represented by a double-headed arrow DH in FIG. 7. The head maximum width DH is a distance in the face-back direction between a forefront point and a backmost point of the head. A distance in the face-back direction between the forefront point of the head and the connecting point A is represented by a double-headed arrow DA in FIG. 7. In respect of increasing a grounding area in addressing and improving the adaptability to a change in the lie in the face-back direction, a ratio (DA/DH) is preferably equal to or greater than 0.5, more preferably equal to or greater than 0.6, and still more preferably equal to or greater than 0.65. In respect of suppressing the grounding at the final stage of the impact to improve the sliding property, the ratio (DA/DH) is preferably equal to or less than 0.85, more preferably equal to or less than 0.8, and still more preferably equal to or less than 0.75.

[Lengths of Edge Lines Eg1 to Eg4]

The area of the sole surface f8 is restricted. Therefore, the lengths of the fourth edge lines Eg1 to Eg4 are also restricted. Meanwhile, in respect of increasing effects of the edge lines Eg1 to Eg4, the edge lines Eg1 to Eg4 are preferably longer. The lengths of the lines Eg1 to Eg4 are along the lines. Therefore, if the line is a curved line, the length is measured along the curved line.

In the above-mentioned respect, the length Lg1 of the first edge line Eg1 is preferably equal to or greater than 30 mm, more preferably equal to or greater than 35 mm, and still more preferably equal to or greater than 40 mm. In the above-mentioned respect, the length Lg1 of the first edge line Eg1 is preferably equal to or less than 70 mm, more preferably equal to or less than 60 mm, and still more preferably equal to or less than 50 mm.

In the above-mentioned respect, the length Lg2 of the second edge line Eg2 is preferably equal to or greater than 30 mm, more preferably equal to or greater than 35 mm, and still more preferably equal to or greater than 40 mm. In the above-mentioned respect, the length Lg2 of the second edge line Eg2 is preferably equal to or less than 70 mm, more preferably equal to or less than 60 mm, and still more preferably equal to or less than 50 mm.

In the above-mentioned respect, the length Lg3 of the third edge line Eg3 is preferably equal to or greater than 5 mm, more preferably equal to or greater than 10 mm, and still more preferably equal to or greater than 15 mm. In the above-mentioned respect, the length Lg3 of the third edge line Eg3 is preferably equal to or less than 50 mm, more preferably equal to or less than 40 mm, and still more preferably equal to or less than 30 mm.

In the above-mentioned respect, the length Lg4 of the fourth edge line Eg4 is preferably equal to or greater than 5 mm, more preferably equal to or greater than 10 mm, and still more preferably equal to or greater than 15 mm. In the above-mentioned respect, the length Lg4 of the fourth edge line Eg4 is preferably equal to or less than 50 mm, more preferably equal to or less than 40 mm, and still more preferably equal to or less than 30 mm.

In lights of adaptability to various lies and adaptability to various swing paths, the length Lg1 is preferably comparable with the length Lg2. Specifically, a ratio (Lg1/Lg2) is preferably 0.8 or greater and 1.2 or less.

In lights of adaptability to various lies and adaptability to various swing paths, the length Lg3 is comparable with the length Lg4. Specifically, a ratio (Lg3/Lg4) is preferably 0.8 or greater and 1.2 or less.

In light of the sliding property of the head at the final stage of the impact, Lg1 is preferably longer than Lg3. Furthermore, a ratio (Lg1/Lg3) is preferably equal to or greater than 1.5, and more preferably equal to or greater than 2. In respect of preventing Lg3 from being too small, the ratio (Lg1/Lg3) is preferably equal to or less than 4, and more preferably equal to or less than 3.

In light of the sliding property of the head at the final stage of the impact, Lg2 is preferably longer than Lg4. Furthermore, a ratio (Lg2/Lg4) is preferably equal to or greater than 1.5, and more preferably equal to or greater than 2. In respect of preventing Lg4 from being too small, the ratio (Lg2/Lg4) is preferably equal to or less than 4, and more preferably equal to or less than 3.

Figure 10:
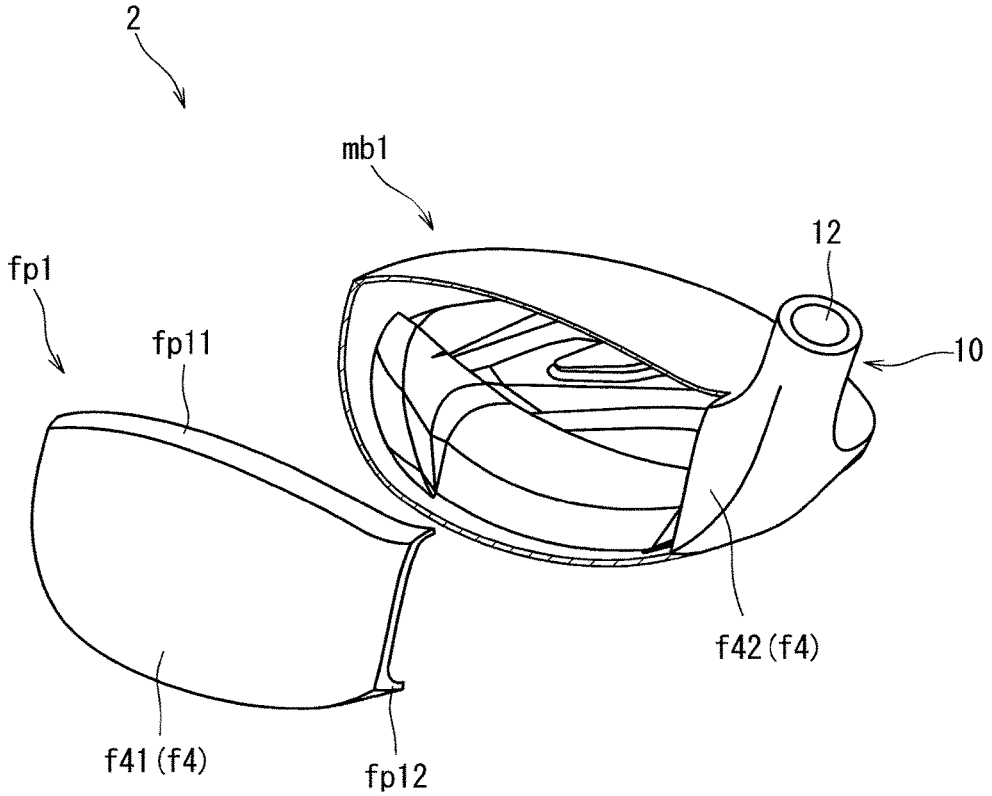
FIG. 10 is an exploded perspective view of the head of FIG. 1.

FIG. 10 is an exploded perspective view of the head 2. A face member fp1 and the remainder are welded to each other to form the head 2. In the embodiment, the remainder is a head body mb1. The embodiment provides a two-piece structure in which two members are joined. The number of the members to be joined is not limited. Examples of the structure include a three-piece structure and a four-piece structure.

The face member fp1 constitutes a part f41 of the face surface f4. The face member fp1 does not constitute the whole face surface f4.

The face member fp1 includes a first extending part fp11 and a second extending part fp12. The first extending part fp11 constitutes a part of the crown 6. The second extending part fp12 constitutes a part of the sole 8.

The head body mb1 constitutes a part of the face surface f4 (heel part f42).

As a result of such a structure, a welding boundary k1 between the head body mb1 and the face member fp1 includes a boundary kf1 on the face surface (see FIG. 1).

Figure 11:
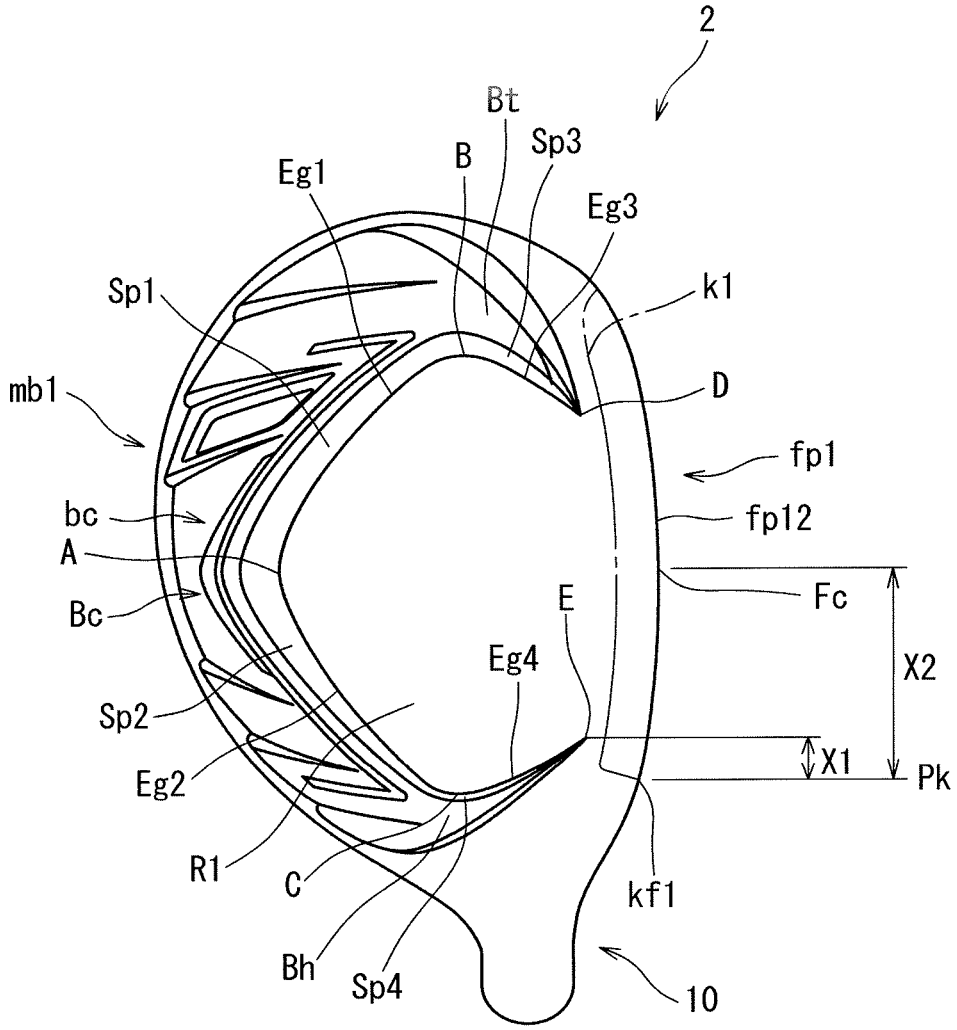
FIG. 11 is the same bottom view as FIG. 2, and a boundary line k1 between members is shown in FIG. 11.

A welding position of the face member fp1 and the head body mb1 on the face surface f4 is represented by reference character Pk in FIG. 11. In the embodiment, the welding position Pk is a position of a heel side end of the face member fp1 on the face surface f4. A distance between the welding position Pk and the endpoint E is represented by a double-headed arrow X1 in FIG. 11. A position of the boundary kf1 closest to the point E in the toe-heel direction is the position Pk. The distance X1 is a distance in the toe-heel direction.

A distance between the position Pk and the face center Fc is represented by a double-headed arrow X2 in FIG. 11. The distance X2 is a distance in the toe-heel direction.

Since the vicinity of the boundary k1 is welded, the vicinity of the boundary k1 has high rigidity. The reason is because the welding part has a larger thickness. Since the boundary kf1 is present on the face surface f4, the vicinity of the boundary kf1 has high face rigidity. A rebound performance can be reduced due to the high rigidity.

In the embodiment, the distance X1 is small. In the vicinity of the point E, sole rigidity is reduced. The sole 8 is likely to be deflected in the vicinity of the point E due to the reduction of the sole rigidity. The deflection of the sole 8 can exhibit an effect of compensating the reduction of the restitution performance caused by the boundary kf1. In respect of increasing a restitution improving effect, the distance X1 is preferably equal to or less than 15 mm, more preferably equal to or less than 10 mm, and still more preferably equal to or less than 7 mm. The lower limit of the distance X1 is equal to or greater than 0 mm.

In respect of the restitution improving effect, the shortest distance between the boundary kf1 and the point E in the face-back direction is preferably equal to or less than 15 mm, more preferably equal to or less than 12 mm, and still more preferably equal to or less than 10 mm. In respect of the strength of the boundary kf1, the shortest distance between the boundary kf1 and the point E in the face-back direction is preferably equal to or greater than 5 mm, and more preferably equal to or greater than 7 mm.

The volume of the head is not limited. In respects of an increase in a moment of inertia and enlargement of an sweet area, the volume of the head is preferably equal to or greater than 100 cc, more preferably equal to or greater than 110 cc, and still more preferably equal to or greater than 120 cc. Even when the area of the sole surface f8 is large, the present invention can effectively suppress the grounding area. Also in this respect, the head volume which is equal to or greater than the lower limit is preferable. In this respect, the head volume is preferably larger. The embodiment is suitably applied also to a driver head, for example. In respect of the rules, the head volume is preferably equal to or less than 470 cc. In respect of the adaptability to various lies, a fairway wood is preferable. In this case, the head volume is preferably equal to or less than 200 cc, more preferably equal to or less than 180 cc, and still more preferably equal to or less than 160 cc.

The material of the head is not limited. Examples of the material of the head include a metal and Carbon Fiber Reinforced Plastic (CFRP). Examples of the metal used for the head include one or more kinds of metals selected from pure titanium, a titanium alloy, stainless steel, maraging steel, an aluminum alloy, a magnesium alloy, and a tungsten-nickel alloy. Examples of stainless steel include SUS630 and SUS304. Specific examples of stainless steel include CUSTOM450 (manufactured by Carpenter Technology Corporation) . Examples of the titanium alloy include 6-4 titanium (Ti-6A1-4V) and Ti-15V-3Cr-3Sn-3A1.

A method for manufacturing the head is not limited. Ordinarily, a hollow head is manufactured by joining two or more members. A method for manufacturing the members constituting the head is not limited. Examples of the method include casting, forging, and press forming.

INDUSTRIAL APPLICABILITY

The present invention can be applied to all golf club heads such as a wood type head, a utility type head, and a hybrid type head.

REFERENCE SIGNS LIST

2 Head
4 Face
f4 Face surface
6 Crown
8 Sole
f8 Sole surface

10 Hosel
12 Shaft hole
R1 First sole region
R2 Second sole region
R3 Third sole region
R4 Front sole region
Eg1 First edge line
Eg2 Second edge line
Eg3 Third edge line
Eg4 Fourth edge line
Sp1 Back side inclined surface of first edge line
Sp2 Back side inclined surface of second edge line
Sp3 Toe side inclined surface of third edge line
Sp4 Heel side inclined surface of fourth edge line
Le Leading edge

The invention claimed is:

1. A golf club head comprising: a shaft hole; a face surface; a sole surface; and a leading edge, wherein the sole surface includes a first sole region; an outer edge of the first sole region includes a first edge line, a second edge line, a third edge line, and a fourth edge line; the first edge line is inclined so as to come closer to the face surface toward a toe side; the second edge line is inclined so as to come closer to the face surface toward a heel side; the third edge line is inclined so as to come closer to the face surface toward the heel side; the fourth edge line is inclined so as to come closer to the face surface toward the toe side;

a back side end of the first edge line and a back side end of the second edge line are joined via a connecting point A;

a face side end of the first edge line and a back side end of the third edge line are joined via a connecting point B, wherein point B and a point D are located at opposite ends of the third edge line;

a face side end of the second edge line and a back side end of the fourth edge line are joined via a connecting point C, wherein point C and a point E are located at opposite ends of the fourth edge line;

a distance between points D and E is less than a difference between points B and C;

the connecting point B is located on the toe side with respect to a face center;

the connecting point C is located on the heel side with respect to the face center;

an outer surface of the first sole region has a projecting curve on a section including the connecting point B and the connecting point C;

the outer surface of the first sole region has a projecting curve on a section including the connecting point A and the face center; and when a state where a center axial line of the shaft hole is included in a plane perpendicular to a level surface and the head is placed at a predetermined lie angle and real loft angle on the level surface is defined as a base state, the first sole region is brought into contact with the level surface in the base state.

2. The golf club head according to claim 1, wherein the sole surface further includes:

a second sole region located on the toe side with respect to a face side end point D of the third edge line; a third sole region located on the heel side with respect to a face side end point E of the fourth edge line; a fifth edge line extending on the toe side from the end point D, and a sixth edge line extending on the heel side from the end point E;

the second sole region and the third sole region smoothly continue toward a back side from the leading edge;

the second sole region is located between the fifth edge line and the leading edge; and the third sole region is located between the sixth edge line and the leading edge.

3. The golf club head according to claim 1, wherein the sole surface further includes a front sole region; and the front sole region forms a continuous surface smoothly joining the leading edge and the first sole region.

4. The golf club head according to claim 2, wherein the sole surface further includes a front sole region;

the front sole region forms a continuous surface smoothly joining the leading edge and the first sole region; and the front sole region forms a continuous surface smoothly joining the second sole region and the third sole region.

5. The golf club head according to claim 1, wherein a face member and the remainder including one or more members are welded to each other; and if a welding position of the face member and the remainder on the face surface is defined as Pk, a distance between the welding position Pk and a face side end point E of the fourth edge line in a toe-heel direction is equal to or less than 10 mm.

6. The golf club head according to claim 5, wherein the remainder is a head body;

and the welding position Pk is a position of a heel side end of the face member on the face surface.

* * * * *